US005393628A

United States Patent [19]

Ikezue et al.

[11] Patent Number: 5,393,628

[45] Date of Patent: Feb. 28, 1995

[54] ELECTROPHOTOGRAPHIC PHOTOSENSITIVE MEMBER, AND ELECTROPHOTOGRAPHIC APPARATUS EMPLOYING THE SAME

[75] Inventors: Tatsuya Ikezue; Kazushige Nakamura, both of Yokohama, Japan

[73] Assignee: Canon Kabushiki Kaisha, Tokyo, Japan

[21] Appl. No.: 79,824

[22] Filed: Jun. 23, 1993

[30] Foreign Application Priority Data

Jun. 25, 1992 [JP] Japan ..... 4-167733
Jun. 30, 1992 [JP] Japan ..... 4-173261

[51] Int. Cl.[6] ..... G03G 5/14; G03G 5/047
[52] U.S. Cl. ..... 430/59; 430/66
[58] Field of Search ..... 430/57, 58, 59, 72, 430/75, 66

[56] References Cited

U.S. PATENT DOCUMENTS 4,119,460 10/1978 Yoerger ..... 96/1 PC
5,194,353 3/1993 Tanaka et al. ..... 430/72
5,246,805 9/1993 Miyazaki et al. ..... 430/72

FOREIGN PATENT DOCUMENTS 1308762 10/1962 France .
2392425 12/1978 France .
1004461 9/1965 United Kingdom .

OTHER PUBLICATIONS

Database WPI Week 9016, AN 90-120730. Mar. 12, 1990.
Pats. Abstracts of Japan, v. 14, No. 445 (P-110) Sep. 25, 1990.
Database WPI week 9016, AN 90-120727, Mar. 12, 1990.
Pat. Abstracts of Japan, v. 14, No. 372 (P-1091) Aug. 10, 1990.

*Primary Examiner*—John Goodrow
*Attorney, Agent, or Firm*—Fitzpatrick, Cella, Harper & Scinto

[57] ABSTRACT

An electrophotographic photosensitive member comprises a support, a photosensitive layer, and optionally a protective layer. At least one of the photosensitive layer and the protective layer contains a pyrazine derivative represented by the general formula:

The electrophotographic photosensitive member is not deteriorated by ozone and nitrogen oxides, and is excellent in durability.

6 Claims, 1 Drawing Sheet

ELECTROPHOTOGRAPHIC PHOTOSENSITIVE MEMBER, AND ELECTROPHOTOGRAPHIC APPARATUS EMPLOYING THE SAME

BACKGROUND OF THE INVENTION

1. Field of the Invention

The present invention relates to an electrophotographic photosensitive member, and an electrophotographic apparatus employing the electrophotographic photosensitive member.

2. Related Background Art

Organic photosensitive members employing organic photoconductive material have come to be widely used as an electrophotographic photosensitive member in recent years. Conventional organic photosensitive members, because of the disadvantages of low sensitivity and low durability thereof, are useful only for low-speed electrophotographic apparatuses. The above disadvantages are being overcome with development of novel materials. Organic photosensitive members, however, have still disadvantages of deterioration of the properties on exposure to ozone or $NO_x$. Since ozone and $NO_x$ are formed in an electrophotographic apparatus, a conventional photosensitive member, when used in an electrophotographic apparatus, is liable to cause deterioration of charge retention ability, decrease of sensitivity, smearing of images, and lowering of other performances.

In order to overcome such disadvantages and to maintain the electrophotographic characteristics, an antioxidant of a hindered phenol type, a phosphine type, or a sulfur type is added into the photosensitive layer to trap ozone and $NO_x$. The addition of the antioxidant, however, tends to cause other disadvantages such as drop of initial sensitivity and rise of residual potential although the resistance to ozone and $NO_x$ is improved. Furthermore, when paper sheets are fed to the electrophotographic apparatus, the antioxidant which has trapped ozone or nitrogen oxides impedes carrier generation or carrier transportation in the photosensitive layer, thereby causing a decrease of sensitivity and chargeability disadvantageously.

SUMMARY OF THE INVENTION

The present invention intends to provide a novel electrophotographic photosensitive member which is not deteriorated by ozone and nitrogen oxides and is satisfactory in durability.

The present invention also intends to provide an electrophotographic apparatus employing the novel electrophotographic photosensitive member.

The electrophotographic photosensitive member of the present invention comprises, in a photosensitive layer or a protecting layer, a pyrazine derivative represented by the general formula (1) below:

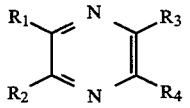

Formul (1)

where $R_1$, $R_2$, $R_3$, and $R_4$ are each independently a hydrogen atom, a hydroxyl group, a halogen atom, or an organic group; and at least one of $R_1$, $R_2$, $R_3$, and $R_4$ is an alkyl group, an allyl group, an aromatic ring group, or a heterocyclic group.

The electrophotographic apparatus of the present invention comprises the aforementioned electrophotographic photosensitive member, an electric charging means for charging the photosensitive member, an image-exposure means for projecting light to form an electrostatic latent image on the photosensitive member, and a developing means for developing the latent image formed on the photosensitive member by use of a toner.

DESCRIPTION OF THE PREFERRED EMBODIMENT

Figure 1:
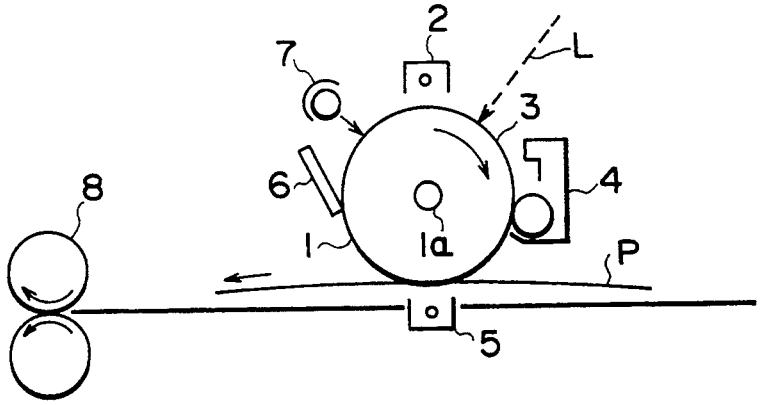
FIG. 1 is a side view of an example of the electrophotographic apparatus employing the electrophotographic photosensitive member of the present invention.

The electrophotographic photosensitive member of the present invention comprises a pyrazine derivative represented by the general formula (1) in a photosensitive layer on a support, or in a protection layer formed, when necessary, on the photosensitive layer:

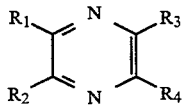

Formul (1)

where $R_1$, $R_2$, $R_3$, and $R_4$ are each independently a hydrogen atom, a hydroxyl group, a halogen atom, or an organic group.

The organic group includes the groups of amino, carboxyl, aldehyde, carbonyl, alkoxy, amide, ester, mercapto, alkyl, allyl, aryl, heterocyclic, etc.

At least one of $R_1$, $R_2$, $R_3$, and $R_4$ is an alkyl group, an allyl group, an aromatic ring group, or a heterocyclic group. The alkyl group and the allyl group include preferably those having 1 to 6 carbon atoms. The aromatic group includes phenyl, naphthyl, anthryl, pyrenyl, naphthacenyl, perylenyl, fluorenyl, phenanthryl, etc. The heterocyclic group includes preferably pyridyl, thienyl, furyl, quinolyl, pyrrolyl, piperidyl, indolyl, pyrimidyl, imidazolyl, etc.

Specific examples of the preferred pyrazine derivative are 2,3,5,6-tetramethylpyrazine, 2,3-dimethylpyrazine, 2,3-diethylpyrazine, 2,3-bis(2-pyridyl)pyrazine, 2,2'-bipyrazine, 4,4'-bipyrazine, 2,3,5-trimethylpyrazine, 2,6-dimethylpyrazine, 2-ethylpyrazine, 2-vinylpyrazine, 2-methyl-3-ethoxypyrazine, 2-methyl-3-isopropoxypyrazine, 2-methyl-3-methoxypyrazine, 5-methylpyrazine-2-carboxylic acid, pyrazine acid, 2-(aminomethyl)-5-methylpyrazine, 2-methylmercapto-3-methylpyrazine, etc.

The photosensitive layer of the electrophotographic photosensitive member in the present invention may be of a single layer structure, or of a lamination structure constituted of at least a charge-generating layer and a charge-transporting layer.

The photosensitive layer of a single layer structure contains a charge-generating substance, a charge transporting substance, and a pyrazine derivative of Formula (1) in one and the same layer to generate and transport photocarriers in the layer.

The photosensitive layer of a lamination structure may have a charge-generating layer containing a charge-generating substance and a charge-transporting layer containing a charge-transporting substance formed in the named order on a support, or formed in the reverse order. The pyrazine derivative of Formula (1) may be incorporated into one of the charge-generating layer and the charge-transporting layer, or in both of the layers.

The pyrazine derivative of Formula (1) is contained in an amount of from 0.01 to 30% by weight, more preferably 0.5 to 20% by weight, still more preferably from 0.5 to 10% by weight, based on the weight of the photosensitive layer.

The charge-generating substance includes phthalocyanine pigments, polycyclic quinone pigments, azo pigments, perylene pigments, indigo pigments, quinacridone pigments, azulenium salt pigments, squarilium dyes, cyanine dyes, pyrylium dyes, thiopyrylium dyes, xanthene coloring matters, quinoneimine coloring matters, triphenylmethane coloring matters, styryl coloring matters, selenium, tellurium, amorphous silicon, cadmium sulfide, etc.

The charge-transporting substance includes pyrene compounds, N-alkylcarbazole compounds, hydrazone compounds, N,N-dialkylaniline compounds, diphenylamine compounds, triphenylamine compounds, triphenylmethane compounds, pyrazoline compounds, styryl compounds, stilbene compounds, polynitro compounds, polycyano compounds, etc., and polymers having the above compound immobilized thereon as a pendant, and so forth.

The photosensitive layer, in the case where it is of a single layer structure, has a thickness of preferably from 10 to 35 μm, more preferably from 15 to 30 μm. The single layer type photosensitive layer contains the charge-generating substance and the charge-transporting substance, respectively, in an amount of from 10 to 70%, more preferably from 20 to 70% by weight, based on the weight of the photosensitive layer.

In the case where the photosensitive layer is of a lamination structure, the charge-generating layer preferably has a thickness of from 0.001 to 6 μm, more preferably from 0.01 to 2 μm, and the charge-transporting layer preferably has a thickness of from 10 to 35 μm, more preferably from 15 to 30 μm. The charge-generating layer preferably contains the charge-generating substance in an amount of from 10 to 100%, more preferably from 50 to 100% by weight. The charge-transporting layer preferably contains the charge-transporting substance in an amount of from 20 to 80%, more preferably from 30 to 70% by weight.

The electrophotographic photosensitive member of the present invention can be prepared by vacuum deposition of substances for the photosensitive layer, or by film formation from a combination of the substances and a suitable binder.

The binder includes polyesters, polyurethanes, polyarylates, polyethylene, polystyrene, polybutadienes, polycarbonates, polyamides, polypropylenes, polyimides, polyamide-imides, polysulfones, polyaryl ethers, polyacetals, nylons, phenol resins, acrylic resins, silicone resins, epoxy resins, allyl resins, alkyd resins, butyral resins, etc., and copolymers thereof.

A protecting film may be provided on the photosensitive layer of the electrophotographic photosensitive member of the present invention. The protecting layer is constructed mainly of a resin. The material constructing the protecting layer includes polyesters, polyurethanes, polyarylates, polyethylene, polystyrene, polybutadienes, polycarbonates, polyamides, polypropylenes, polyimides, polyamide-imides, polysulfones, polyaryl ethers, polyacetals, nylons, phenol resins, acrylic resins, silicone resins, epoxy resins, urea resins, allyl resins, alkyd resins, butyral resins, etc. The protecting layer preferably has a thickness of from 0.05 to 15 μm, more preferably from 1 to 10 μm.

The protecting layer may contain the pyrazine derivative of Formula (1) in a preferred amount of from 0 to 40% by weight based on the weight of the protecting layer.

The protecting layer may contain a charge-transporting substance for retaining the charge-transporting properties of the protecting layer, electroconductive inorganic particles for controlling the electric resistance of the protecting layer, fluorine-containing fine particles for lowering the friction resistance of the surface of the protecting layer, etc. Specifically the charge-transporting substance for the protecting layer includes those mentioned above. The electroconductive particles include particles of $SnO_2$, ITO, etc. The fluorine-containing fine resin particles include particles of polytetrafluoroethylene, polychlorotrifluoroethylene, polyvinylidene fluoride, polydichlorodifluoroethylene, tetrafluoroethylene-perfluoroalkyl vinyl ether copolymers, tetrafluoroethylene-hexafluoropropylene copolymers, tetrafluoroethylene-ethylene copolymers, tetrafluoroethylene-hexafluoropropylene-perfluoroalkyl vinyl ether copolymers, and combinations of two or more of them.

The support may be made of an electroconductive material such as metals and alloys of iron, copper, nickel, aluminum, titanium, tin, antimony, indium, lead, zinc, gold, and silver, etc., and oxides thereof, carbon, and electroconductive resins. The support is preferably in a shape of a cylinder, a belt, or a sheet. The support may be produced by molding the above electroconductive material into a desired shape, or may be prepared by applying as a coating material or vapor-depositing the above electroconductive material on another supporting member.

Between the support and the photosensitive layer, a subbing layer may be provided. The subbing layer serves to control charge injection at the interface or as an adhesive layer. The subbing layer is mainly composed of a binder resin which may contain an electroconductive material or a surfactant. The binder resin for constructing the subbing layer includes polyesters, polyurethanes, polyarylates, polyethylene, polystyrene, polybutadienes, polycarbonates, polyamides, polypropylenes, polyimides, polyamide-imides, polysulfones, polyaryl ethers, polyacetals, nylons, phenol resins, acrylic resins, silicone resins, epoxy resins, urea resins, allyl resins, alkyd resins, butyral resins, etc. The subbing layer preferably has a thickness of from 0.05 to 7 μm, more preferably from 0.1 to 2 μm.

The photosensitive layer or the protecting layer may be formed by coating application by bar coater coating, knife coater coating, roll coater coating, spray coating, dip coating, electrostatic coating, powder coating, or the like. The photosensitive layer may be formed by vapor deposition.

An electrophotographic apparatus and a facsimile machine provided with the electrophotographic photosensitive member of the present invention are explained below.

FIG. 1 illustrates schematically an example of the constitution of a transfer type electrophotographic apparatus employing an electrophotographic photosensitive member of the present invention.

In FIG. 1, a drum-shaped electrophotographic photosensitive member 1 of the present invention is driven to rotate around the axis 1*a* in the arrow direction at a prescribed peripheral speed. The photosensitive member 1 is uniformly charged positively or negatively at the peripheral face during the rotation by an electrostatic charging means 2, and then exposed to image-exposure light L (e.g., slit exposure, laser beam-scanning exposure, etc.) at the exposure portion 3 with an image-exposure means (not shown in the drawing), whereby an electrostatic latent image is successively formed on the peripheral surface in accordance with the image exposure.

The formed electrostatic latent image is developed with a toner by a developing means 4. The developed toner image is successively transferred by a transfer means 5 onto a surface of a recording medium P which is fed between the photosensitive member 1 and the transfer means 5 synchronously with the rotation of the photosensitive member 1 from a feeder not shown in the drawing.

The recording medium P which has received the transferred image is separated from the photosensitive member surface, and introduced to an image fixing means 8 for fixation of the image and sent out from the copying machine as a duplicate copy.

The surface of the photosensitive member 1, after the image transfer, is cleaned with a cleaning means 6 to remove any remaining non-transferred toner, and is treated for charge elimination with a pre-exposure means 7 for repeated use for image formation.

The generally employed charging means 2 for uniformly charging the photosensitive member 1 is a corona charging apparatus. The generally employed transfer means 5 is also a corona charging means. In the electrophotographic apparatus, two or more of the constitutional elements of the above-described photosensitive member 1, the developing means 4, the cleaning means 6, etc. may be integrated into one device unit, which may be made demountable from the main body of the apparatus. For example, the cleaning means 6 is combined with the photosensitive member 1 into one device unit which is demountable from the main body of the apparatus by aid of a guiding means such as a rail in the main body of the apparatus. The device unit may have a charging means and/or a developing means.

When the electrophotographic apparatus is used as a copying machine or a printer, the optical image exposure light L may be projected onto the photosensitive member as reflected light or transmitted light from an original copy, or otherwise the information read out by a sensor from an original may be signalized, and light is projected, onto a photosensitive member, by scanning with a laser beam, driving a light-emitting diode array, or driving a liquid crystal shutter array according to the signal.

When the electrophotographic apparatus is used as a printer of a facsimile machine, the optical image exposure light L is employed for printing the received data.

Figure 2:
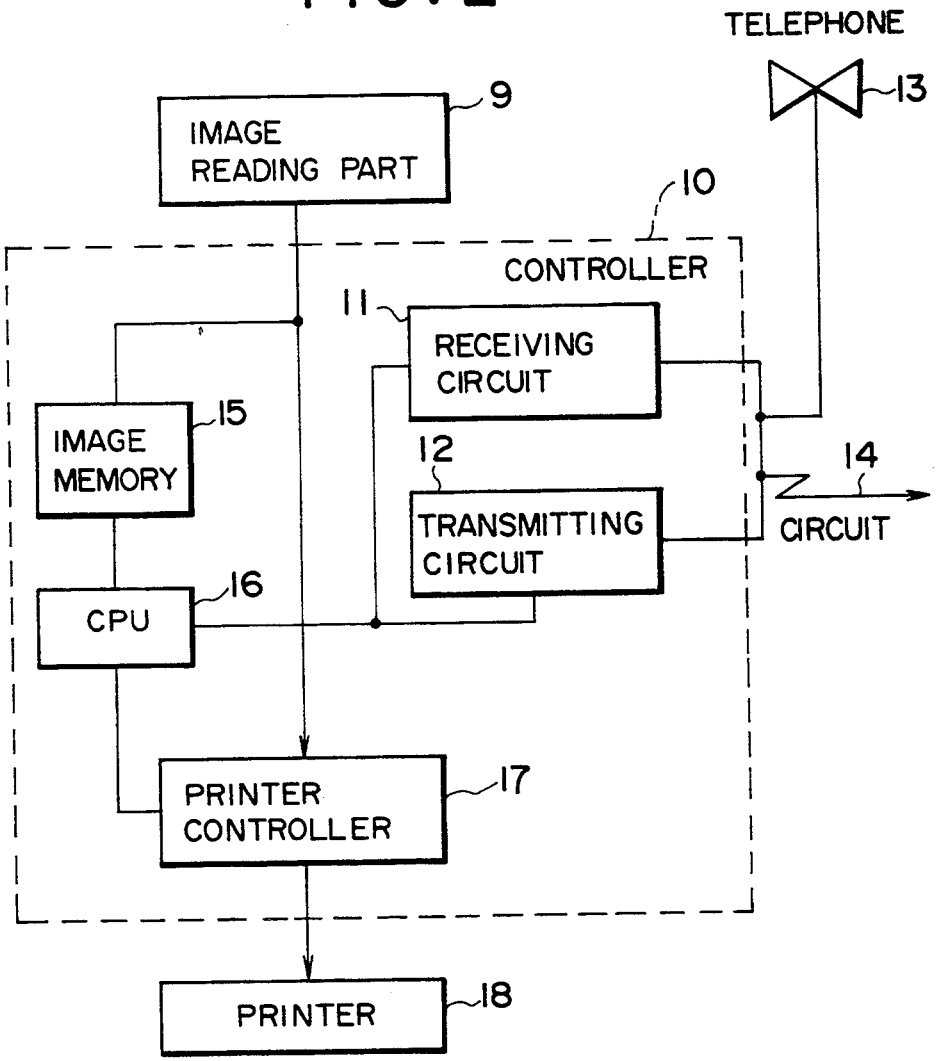
FIG. 2 is a block diagram of an example of a facsimile system employing the electrophotographic apparatus of the present invention.

FIG. 2 is a block diagram of an example of a facsimile system employing the electrophotographic photosensitive member as the printer.

A controller 10 controls the image-reading part 9 and a printer 18. The entire of the controller 10 is controlled by a CPU 16. Readout data from the image reading part 9 is transmitted through a transmitting circuit 12 to the other communication station. Data received from the other communication station is transmitted through a receiving circuit 11 to a printer 18. The image data is stored in an image memory 15. A printer controller 17 controls a printer 18. The numeral 13 denotes a telephone set.

The image received through a circuit 14, namely image information from a remote terminal connected through the circuit, is demodulated by the receiving circuit 11, treated for decoding of the image information in CPU 16, and successively stored in the image memory 15. When at least one page of image information has been stored in the image memory 15, the images are recorded in such a manner that the CPU 16 reads out one page of the image information, and sends out the one page of the signalized information to the printer controller 17, which controls the printer 18 on receiving the one page of the information from CPU 16 to record the image information.

During recording by the printer 18, the CPU 16 receives the subsequent page of information.

Images are received and recorded in the manner as described above.

The present invention is described in more detail with reference to examples. In Examples, "parts" is based on weight.

EXAMPLE 1

10 Parts of nylon (M-4000, made by Toray Industries, Inc.), 100 parts of methanol, and 90 parts of isopropanol were mixed to prepare a solution. This solution was applied by dip coating on an aluminum cylinder of 80 mm in diameter, 1.5 mm in thickness, and 363 mm in length, and was dried at 90° C. for 20 minutes to form a subbing layer of 2.0 μm thick on the aluminum cylinder.

Separately, a coating liquid for a charge-generating layer was prepared by dispersing 10 parts of tris azo pigment represented by the formula below, 5 parts of polycarbonate (bisphenol A type, number-average molecular weight (Mn): 20,000), and 600 parts of cyclohexanone by means of a sand mill:

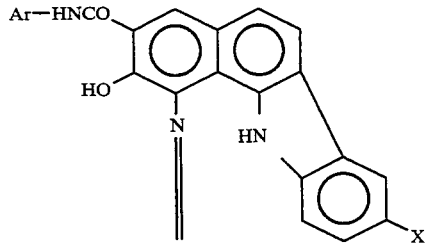

-continued

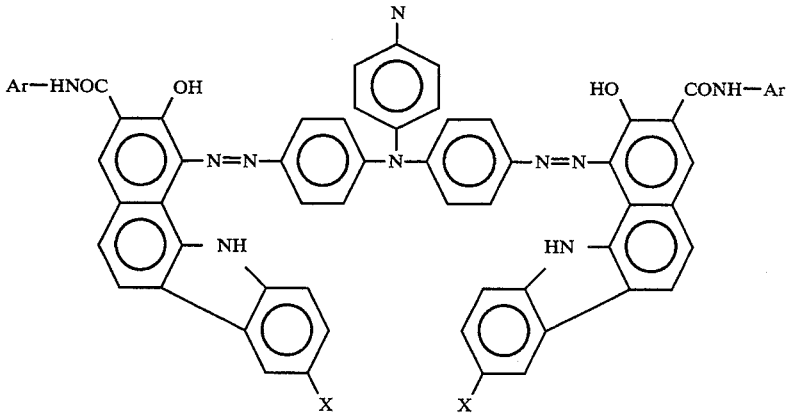

where Ar is:

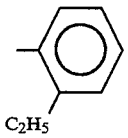

and X is —Cl. This coating liquid was applied on the aforementioned subbing layer, and was dried at 120° C. for 20 minutes to form a charge-generating layer of 0.15 μm thick.

Then 50 parts of the styryl compound represented by the formula below:

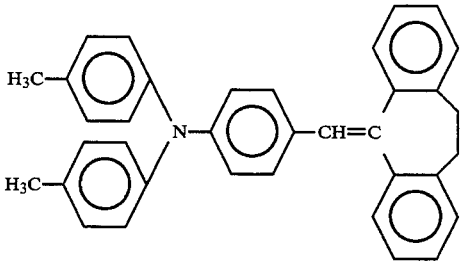

50 parts of polycarbonate (bisphenol Z type, Mn: 25,000), and 0.1 parts of the pyrazine derivative represented by the formula below:

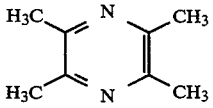

were dispersed in 800 parts of chlorobenzene by means of a ball mill to prepare a coating liquid for the charge-transporting layer. This coating liquid was applied on the aforementioned charge-generating layer by dip coating, and was dried at 130° C. for 90 minutes to form a charge-transporting layer of 18 μm thick, thus completing an electrophotographic photosensitive member of the present invention.

Other electrophotographic photosensitive members were prepared in the same manner as described above, except that the amount of the pyrazine derivative was changed to 0.25 part, 0.5 part, 1.0 part, 2.0 parts, 4.0 parts, or 8.0 parts as shown in Table 1.

The electrophotographic photosensitive member thus prepared was mounted on an electrophotographic apparatus (made by Canon K.K., trade name: CLC-500). With this apparatus, continuous copying of 10,000 sheets was conducted. The results are shown in Table 1.

TABLE 1

| Amount of pyrazine (parts by weight) | 0.1 | 0.25 | 0.5 | 1.0 | 2.0 | 4.0 | 8.0 |
|---|---|---|---|---|---|---|---|
| Image quality | Δ | Δ | 0 | 0 | 0 | 0 | 0 |

Δ: Undesired image of stripes appearing slightly across the recording paper sheet, but no problem practically
0: Clear image obtained

EXAMPLE 2

An aluminum sheet of 250 mm long, 150 mm wide, and 0.5 mm thick was used as an electroconductive support. On this aluminum sheet, a subbing layer, a charge-generating layer, and a charge-transporting layer which were the same as those in Example 1 were formed by bar coater coating to prepare seven kinds of electrophotographic photosensitive members of the present invention.

The obtained seven kinds of electrophotographic photosensitive members were tested for the sensitivity and the residual potential at a temperature of 25° C. and a humidity of 50% by means of a paper analyzer (trade name EPA-8100, made by Kawaguchi Denki K.K.). The results are shown in Table 2.

TABLE 2

| Amount of pyrazine (parts by weight) | 0.1 | 0.25 | 0.5 | 1.0 | 2.0 | 4.0 | 8.0 |
|---|---|---|---|---|---|---|---|
| Sensitivity ($\mu J/cm^2$) | 0.50 | 0.51 | 0.50 | 0.53 | 0.52 | 0.55 | 0.60 |
| Residual potential (V) | 10 | 10 | 15 | 15 | 15 | 20 | 30 |

The sensitivity in the present invention means a quantity of light energy per unit area required to reduce the charged potential to a $\frac{1}{2}$ value of the initial charged potential when light is projected onto a charged electrophotographic photosensitive member. In this Example, the initial charged potential was −600 V, and the wavelength of the light was 790 nm.

The residual potential in the present invention means a charged potential 0.5 second after the completion of eliminating, with a halogen lamp, charge of the electrophotographic photosensitive member having been charged at −600 V.

Then, the above seven kinds of sheet-shaped electrophotographic photosensitive members were subjected to durability test corresponding to 10000-sheet continuous copying at a high temperature of 30° C. and a high humidity of 85% by means of the paper analyzer. The results are shown in Table 3.

Table 3 shows the changes of the respective potentials after the charging step, the image-exposure step, and the charge elimination step caused by the durability test. In more detail, before the durability test, the charged potentials after completion of the steps of charging, image-exposure, and charge elimination are measured, respectively, and further, after the durability test, the electrophotographic photosensitive member is treated through the same steps, and the corresponding potentials are measured. The changes of the potentials are shown in Table 3.

TABLE 3

| Amount of pyrazine (parts by weight) | 0.1 | 0.25 | 0.5 | 1.0 | 2.0 | 4.0 | 8.0 |
|---|---|---|---|---|---|---|---|
| Dark part potential change ΔVd (V) | 0 | 0 | −5 | 0 | 0 | +5 | +15 |
| Light part potential change ΔVl (V) | +10 | 0 | 0 | +5 | −10 | +10 | +50 |
| Residual potential change ΔVr (V) | +5 | 0 | +5 | +1 | 0 | +10 | +50 |

In Table 3, the dark part potential change ΔVd means the change of the potential after the charging step; the light part potential change ΔV1 means the change of the potential after completion of image exposure step; and the residual potential change ΔVr means the change of the potential after completion of the destaticizing step.

EXAMPLE 3

A coating liquid for a protection layer was prepared by dispersing one part of fine particulate polytetrafluoroethylene (Lubron-L-5, made by Daikin Industries, Ltd.), 6 parts of polycarbonate (bisphenol Z type Mn: 30,000), 3 parts of the styryl compound represented by the formula below:

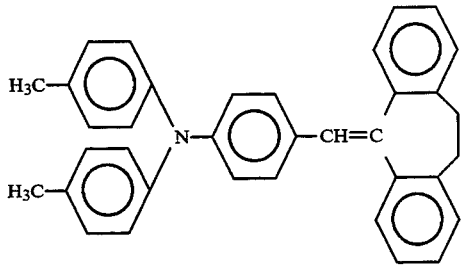

and 0.09 part of the pyrazine derivative represented by the formula below:

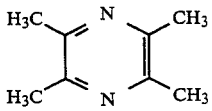

in 500 parts of dichloromethane by means of a sand mill.

Separately an electrophotographic photosensitive member was prepared in the same manner as in Example 1. Thereon the coating liquid prepared above was applied by dip coating, and was dried at 130° C. for 30 minutes to form a protecting layer of 3.0 μm thick.

Other electrophotographic photosensitive members of the present invention were prepared in the same manner as described above except that the amount of the pyrazine derivative was 0.03 part, 0.15 part, 0.20 part, or 0.30 part.

The electrophotographic photosensitive member thus prepared was mounted on an electrophotographic apparatus (made by Canon K.K., trade name: CLC-500). With this apparatus, continuous copying of 10,000 sheets was conducted. The results are shown in Table 4.

TABLE 4

| Amount of pyrazine (parts by weight) | 0.03 | 0.09 | 0.15 | 0.20 | 0.30 |
|---|---|---|---|---|---|
| Image quality | Δ | 0 | 0 | 0 | 0 |

Δ: Undesired image of stripes appearing slightly across the recording paper sheet, but no problem practically
0: Clear image obtained

EXAMPLE 4

An aluminum sheet of 250 mm long, 150 mm wide, and 0.5 mm thick was used as an electroconductive support. On this aluminum sheet, a subbing layer, a charge-generating layer, a charge-transporting layer, and a protecting layer were formed in the same manner as in Example 3 by bar coater coating to prepare 5 kinds of electrophotographic photosensitive members of the present invention.

The obtained 5 kinds of electrophotographic photosensitive members were tested for the sensitivity and the residual potential in the same manner as in Example 2. The results are shown in Table 5.

TABLE 5

| Amount of pyrazine (parts by weight) | 0.03 | 0.09 | 0.15 | 0.20 | 0.30 |
|---|---|---|---|---|---|
| Sensitivity ($\mu J/cm^2$) | 0.53 | 0.51 | 0.51 | 0.52 | 0.60 |
| Residual potential (V) | 10 | 10 | 10 | 15 | 30 |

Then, the above 5 kinds of sheet-shaped electrophotographic photosensitive members were subjected to durability test in the same manner as in Example 2. The results are shown in Table 6.

TABLE 6

| Amount of pyrazine (parts by weight) | 0.03 | 0.09 | 0.15 | 0.20 | 0.30 |
|---|---|---|---|---|---|
| Dark part potential change ΔVd (V) | +5 | +5 | 0 | +5 | +10 |
| Light part | −5 | +5 | −10 | +5 | +30 |

TABLE 6-continued

| Amount of pyrazine (parts by weight) | 0.03 | 0.09 | 0.15 | 0.20 | 0.30 |
|---|---|---|---|---|---|
| potential change ΔVl (V) | | | | | |
| Residual potential change ΔVr (V) | 0 | 0 | +5 | +10 | +30 |

EXAMPLE 5

Six kinds of electrophotographic photosensitive members of the present invention were prepared in the same manner as in Example 1 except that the pyrazine derivative was the one represented by the formula below and were used in the amount shown in Table 7:

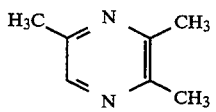

The electrophotographic photosensitive member thus prepared was mounted on an electrophotographic apparatus (made by Canon K.K., trade name: CLC-500). With this apparatus, continuous copying of 10,000 sheets was conducted. The results are shown in Table 7.

TABLE 7

| Amount of pyrazine (parts by weight) | 0.3 | 0.5 | 1.0 | 2.0 | 5.0 | 8.0 |
|---|---|---|---|---|---|---|
| Image quality | Δ | 0 | 0 | 0 | 0 | 0 |

Δ: Undesired image of stripes appearing slightly across the recording paper sheet, but no problem practically
0: Clear image obtained

EXAMPLE 6

An aluminum sheet of 250 mm long, 150 mm wide, and 0.5 mm thick was used as an electroconductive support. On this aluminum sheet, a subbing layer, a charge-generating layer, and a charge-transporting layer were formed in the same manner as in Example 5 by bar coater coating to prepare 6 kinds of electrophotographic photosensitive members of the present invention.

The obtained 5 kinds of electrophotographic photosensitive members were tested for the sensitivity and the residual potential in the same manner as in Example 2. The results are shown in Table 8.

TABLE 8

| Amount of pyrazine (parts by weight) | 0.3 | 0.5 | 1.0 | 2.0 | 5.0 | 8.0 |
|---|---|---|---|---|---|---|
| Sensitivity ($\mu J/cm^2$) | 0.51 | 0.52 | 0.53 | 0.52 | 0.55 | 0.64 |
| Residual potential (V) | 10 | 10 | 15 | 15 | 20 | 35 |

Then, the above 5 kinds of sheet-shaped electrophotographic photosensitive members were subjected to durability test in the same manner as in Example 2. The results are shown in Table 9.

TABLE 9

| Amount of pyrazine (parts by weight) | 0.3 | 0.5 | 1.0 | 2.0 | 5.0 | 8.0 |
|---|---|---|---|---|---|---|
| Dark part potential change ΔVd (V) | +5 | 0 | −5 | 0 | +10 | +20 |
| Light part potential change ΔVl (V) | 0 | 0 | +5 | 0 | +10 | +40 |
| Residual potential change ΔVr (V) | 0 | +5 | 0 | +5 | +15 | +50 |

COMPARATIVE EXAMPLE 1

An electrophotographic photosensitive member was prepared in the same manner as in Example 5 except that no pyrazine derivative was used.

The electrophotographic photosensitive member thus prepared was mounted on an electrophotographic apparatus (made by Canon K.K., trade name: CLC-500). With this apparatus, continuous copying of 10,000 sheets was conducted. As the result, undesired black image in stripes appeared across the recording paper sheet.

EXAMPLE 7

Six kinds of electrophotographic photosensitive members of the present invention were prepared in the same manner as in Example 1 except that the pyrazine derivative was the one represented by the formula below and were used in the amount shown in Table 10:

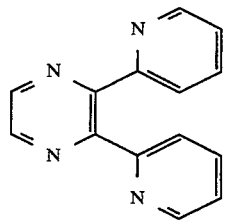

The electrophotographic photosensitive member thus prepared was mounted on an electrophotographic apparatus (made by Canon K.K., trade name: CLC-500). With this apparatus, continuous copying of 10,000 sheets was conducted. The results are shown in Table 10.

TABLE 10

| Amount of pyrazine (parts by weight) | 0.3 | 0.7 | 1.5 | 2.5 | 4.0 | 5.5 |
|---|---|---|---|---|---|---|
| Image quality | Δ | 0 | 0 | 0 | 0 | 0 |

EXAMPLE 8

An aluminum sheet of 250 mm long, 150 mm wide, and 0.5 mm thick was used as an electroconductive support. On this aluminum sheet, a subbing layer, a charge-generating layer, and a charge-transporting layer were formed in the same manner as in Example 7 by bar coater coating to prepare six kinds of electrophotographic photosensitive members of the present invention.

The obtained six kinds of electrophotographic photosensitive members were tested for the sensitivity and the residual potential in the same manner as in Example 2. The results are shown in Table 11.

TABLE 11

| Amount of pyrazine (parts by weight) | 0.3 | 0.7 | 1.5 | 2.5 | 4.0 | 5.5 |
|---|---|---|---|---|---|---|
| Sensitivity ($\mu J/cm^2$) | 0.52 | 0.50 | 0.53 | 0.51 | 0.55 | 0.65 |
| Residual potential (V) | 15 | 15 | 10 | 20 | 20 | 50 |

COMPARATIVE EXAMPLE 2

An electrophotographic photosensitive member was prepared in the same manner as in Example 7 except that no pyrazine derivative was used.

The electrophotographic photosensitive member thus prepared was mounted on an electrophotographic apparatus (made by Canon K.K., trade name:. CLC-500). With this apparatus, continuous copying of 10,000 sheets was conducted. As the result, undesired black image in stripes appeared across the recording paper sheet.

EXAMPLE 9

On the same aluminum cylinder as used in Example 1, a subbing layer was formed in the same manner as in Example 1.

In 615 parts of the coating liquid for a charge-generating layer prepared in Example 1, 0.1 part of 2,3,5,6-tetramethylpyrazine, namely the pyrazine derivative used in Example 1, was dispersed by means of a sand mill. This coating liquid was applied on the above subbing layer by dip coating, and was dried at 120° C. for 20 minutes to form a charge-generating layer of 0.15 $\mu$m thick.

A coating liquid for a charge-transporting layer was prepared in the same manner as in Example 1 except that the pyrazine derivative was not added. This coating liquid was applied on the above charge-generating layer by dip coating, and was dried at 130° C. for 90 minutes to form a charge-transporting layer of 18 $\mu$m thick. Thus an electrophotographic photosensitive member of the present invention was completed.

Further, electrophotographic photosensitive members of the present invention were prepared similarly by using the pyrazine derivative in an amount of 0.15 part, 0.30 part, 0.50 part, or 0.70 part.

The electrophotographic photosensitive member thus prepared was mounted on an electrophotographic apparatus (made by Canon K.K., trade name: CLC-500). With this apparatus, continuous copying of 10,000 sheets was conducted. The results are shown in Table 12.

TABLE 12

| Amount of pyrazine (parts by weight) | 0.1 | 0.15 | 0.30 | 0.50 | 0.70 |
|---|---|---|---|---|---|
| Image quality | Δ | Δ | 0 | 0 | 0 |

Δ: Undesired image of stripes appearing slightly across the recording paper sheet, but no problem practically
0: Clear image obtained

EXAMPLE 10

An aluminum sheet of 250 mm long, 150 mm wide, and 0.5 mm thick was used as an electroconductive support. On this aluminum sheet, a subbing layer, a charge-generating layer, and a charge-transporting layer were formed in the same manner as in Example 9 by bar coater coating to prepare 5 kinds of electrophotographic photosensitive members of the present invention.

The obtained 5 kinds of electrophotographic photosensitive members were tested for the sensitivity and the residual potential in the same manner as in Example 2. The results are shown in Table 13.

TABLE 13

| Amount of pyrazine (parts by weight) | 0.1 | 0.15 | 0.15 | 0.30 | 0.70 |
|---|---|---|---|---|---|
| Sensitivity ($\mu J/cm^2$) | 0.55 | 0.52 | 0.54 | 0.52 | 0.55 |
| Residual potential (V) | 15 | 20 | 15 | 20 | 25 |

EXAMPLE 11

An electrophotographic photosensitive member of the present invention was prepared in the same manner as in Example 9 except that the 2,3,5,6-tetramethylpyrazine (0.1 part) was replaced by 0.7 part of the pyrazine derivative represented by the formula below:

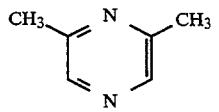

The electrophotographic photosensitive member thus prepared was mounted on an electrophotographic apparatus (made by Canon K.K., trade name: CLC-500). With this apparatus, continuous copying of 10,000 sheets was conducted. Clear images were obtained even after the continuous 10000-sheet copying.

What is claimed is:

1. An electrophotographic photosensitive member comprising a photosensitive layer which comprises a charge-generating layer laminated to a charge-transporting layer on a support, the charge-transporting layer containing a pyrazine derivative represented by the general formula (1):

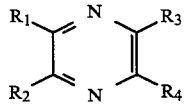

Formula (1)

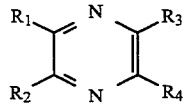

Formual (1)

wherein $R_1$, $R_2$, $R_3$, and $R_4$ are each independently a hydrogen atom, a hydroxyl group, a halogen atom, or an organic group; and at least one of $R_1$, $R_2$, $R_3$, and $R_4$ is an alkyl group, an allyl group, an aromatic ring group, or a heterocyclic group.

2. An electrophotographic photosensitive member according to claim 1, wherein both the charge-generating layer and the charge-transporting layer contain the pyrazine derivative.

3. An electrophotographic photosensitive member comprising a photosensitive layer on a support, and a protecting layer formed further thereon, the protecting layer at least containing a pyrazine derivative represented by the general formula (1):

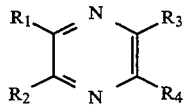

Formual (1)

where $R_1$, $R_2$, $R_3$, and $R_4$ are each independently a hydrogen atom, a hydroxyl group, a halogen atom, or an organic group; and at least one of $R_1$, $R_2$, $R_3$, and $R_4$ is an alkyl group, an allyl group, an aromatic ring group, or a heterocyclic group.

4. An electrophotographic photosensitive member according to claim 3, wherein the photosensitive layer is of a single layer structure.

5. An electrophotographic photosensitive member according to claim 3, wherein the photosensitive layer is of a laminated layer structure constructed of a charge-generating layer and a charge-transporting layer.

6. An electrophotographic apparatus comprising the electrophotographic photosensitive member of claim 1 or claim 3, an electric charging means for charging the photosensitive member, an image-exposure means for projecting light to form an electrostatic latent image on the photosensitive member, and a developing means for developing the latent image formed on the photosensitive member by using a toner.

* * * * *

UNITED STATES PATENT AND TRADEMARK OFFICE

CERTIFICATE OF CORRECTION

PATENT NO. : 5,393,628

DATED : February 28, 1995

INVENTORS : TATSUYA IKEZUE, ET AL.

It is certified that error appears in the above-identified patent and that said Letters Patent is hereby corrected as shown below:

COLUMN 1

Line 58, "Formual (1)" should read --Formula (1)--.

COLUMN 2

Line 28, "Formual (1)" should read --Formula (1)--.

COLUMN 6

Line 12, "entire" should read --entirety--.

COLUMN 12

Insert after Table 10:
--Δ: Undesired image of stripes appearing slightly across the recording paper sheet, but no problem practically
0: Clear image obtained--.

COLUMN 14

TABLE 13, "0.15 0.15" should read --0.15 0.20--.

Line 59, " 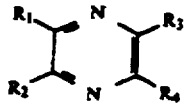 Formula (1) " should be deleted.

UNITED STATES PATENT AND TRADEMARK OFFICE

CERTIFICATE OF CORRECTION

PATENT NO. : 5,393,628

DATED : February 28, 1995

INVENTORS : TATSUYA IKEZUE, ET AL.

It is certified that error appears in the above-identified patent and that said Letters Patent is hereby corrected as shown below:

COLUMN 15

Line 11, "Formual (1)" should read --Formula (1)--.

Signed and Sealed this

Twenty-third Day of May, 1995

Bruce Lehman

BRUCE LEHMAN

*Commissioner of Patents and Trademarks*

*Attest:*

*Attesting Officer*